US012773598B2

(12) United States Patent
Crockett et al.

(10) Patent No.: US 12,773,598 B2
(45) Date of Patent: Oct. 27, 2026

(54) BALL FOR GAME AND RULES OF PLAY

(71) Applicants: Joshua John Crockett, Parker, CO (US); Karen Bernadette Crockett, Parker, CO (US)

(72) Inventors: Joshua John Crockett, Parker, CO (US); Karen Bernadette Crockett, Parker, CO (US)

(73) Assignee: Cup it!LLC, Parker, CO (US)

( * ) Notice: Subject to any disclaimer, the term of this patent is extended or adjusted under 35 U.S.C. 154(b) by 94 days.

(21) Appl. No.: 19/057,431

(22) Filed: Feb. 19, 2025

(65) Prior Publication Data

US 2025/0269245 A1 Aug. 28, 2025

Related U.S. Application Data

(60) Provisional application No. 63/556,440, filed on Feb. 22, 2024.

(51) Int. Cl.
*A63B 37/14* (2006.01)

(52) U.S. Cl.
CPC ..... *A63B 37/14* (2013.01)

(58) Field of Classification Search
CPC ..... A63B 37/14
USPC ..... 473/569
See application file for complete search history.

(56) References Cited

U.S. PATENT DOCUMENTS 4,511,148 A 4/1985 Amos et al.
5,133,550 A 7/1992 Handy
2006/0205544 A1* 9/2006 Wyner ..... A63H 27/10 473/588
2007/0049434 A1* 3/2007 Maziarz ..... A63B 41/00 473/607
2008/0108462 A1* 5/2008 Krysiak ..... A63B 41/08 473/603
2009/0325742 A1* 12/2009 Krysiak ..... A63B 41/08 473/605
2025/0276219 A1* 9/2025 Vantrease ..... A63B 43/002

OTHER PUBLICATIONS

Joshua John Crockett and Karen Bernadette Crockett, "Inventors Joint Statement Concerning Non-Patent Literature (NPL) for the Examiner's Consideration as cited in the Information Disclosure Statement (IDS)".

(Continued)

*Primary Examiner* — Daniel A Hess
(74) *Attorney, Agent, or Firm* — Trenner Law Firm, LLC; Mark Trenner

(57) ABSTRACT

A game ball is disclosed which may be tossed and caught using a cup according to rules of game play. An example game ball includes a spherical body defined by a central axis extending between a first pole and a second pole on opposite ends of the spherical body. The spherical body is further defined by a plurality of equally spaced longitudinal lines extending between the first pole and the second pole. The spherical body is further defined by an equatorial circumference that is uniformly equidistant from the first pole and the second pole. A plurality of rib structures of the spherical body are provided substantially symmetrical about the longitudinal lines between the first pole and the second pole of the spherical body.

20 Claims, 7 Drawing Sheets

(56) References Cited

OTHER PUBLICATIONS

Christian Camp Pro "12 Red Solo Cup Games To Play At Your Next Event" available on the Internet at https://christiancamppro.com/12-red-solo-cup-games-to-play-at-your-next-event/#CATCH_THAT_BALL at least as early as Apr. 23, 2024.
Amazon.com "Ballz Up!" available on the Internet at https://www.amazon.com/Ballz-Swing-Away-Party-Game/dp/B07YDGF3P5 at least as early as Apr. 23, 2024.
Amazon.com "Geospace The Original Pop 'N Catch Game" available on the Internet at https://www.amazon.com/Original-Catch-Game-Geospace-Double/dp/B0049HVVLW/ref=sr_1_1?sr=8-1 at least as early as Apr. 23, 2024.
Playability Toys "Jacob's Rib-It-Ball" available on the Internet at https://playabilitytoys.com/products/jacobs-rib-ball-14-inch/ at least as early as Apr. 23, 2024.
Bassalo "New Cupball Sports Game" available on the Internet at https://www.bassalo-cupball.com/en-gb/home at least as early as Apr. 23, 2024.

* cited by examiner

BALL FOR GAME AND RULES OF PLAY

PRIORITY CLAIM

This application claims the priority filing benefit of U.S. Provisional Patent Application No. 63/556,440 filed Feb. 22, 2024 for "Ball For Game And Rules Of Play" of Joshua John Crockett and Karen Bernadette Crockett, hereby incorporated by reference in its entirety as though fully set forth herein.

COPYRIGHT OR MASK WORK NOTICE

A portion of the disclosure of this patent document contains material which is subject to (copyright or mask work) protection. The (copyright or mask work) owner has no objection to the reproduction by anyone of the patent document or the patent disclosure, as it appears in the Patent and Trademark Office patent file or records, but otherwise reserves all (copyright or mask work) rights whatsoever.

BACKGROUND

Games of play have been a fundamental part of human social interaction for centuries, offering a means of entertainment, bonding, and cognitive stimulation. They are essential in making time spent with friends and family more enjoyable and engaging. However, many of the traditional games that people play can become monotonous and repetitive over time. This can lead to a decline in interest and excitement, as players often seek novel and challenging experiences to keep them engaged.

Innovation in game design is crucial to address this need for new and captivating games. It is important to create games that not only entertain but also provide fresh and stimulating experiences for players.

DETAILED DESCRIPTION

Figure 1:
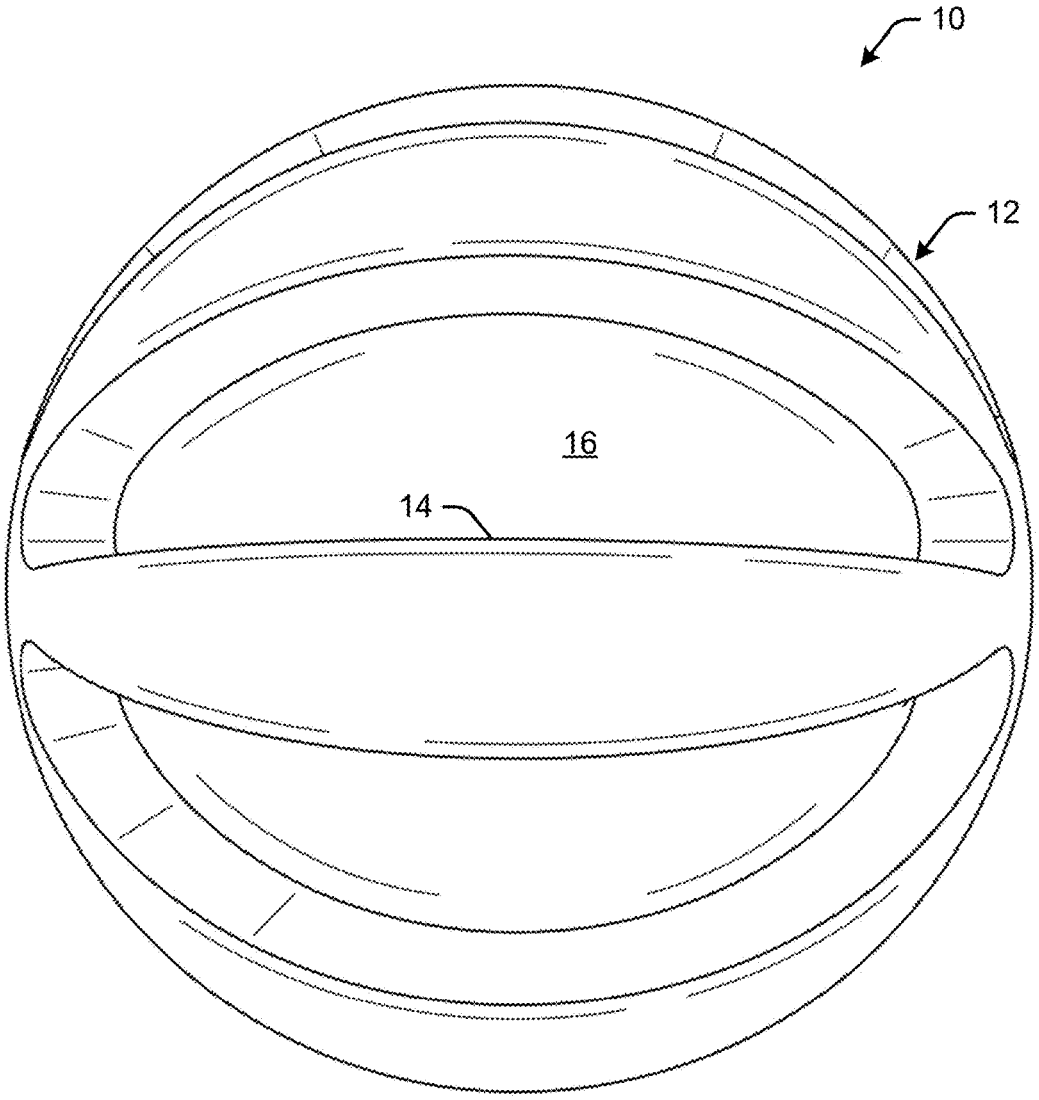
FIG. 1 shows an example game ball.

The development of new games requires a thoughtful consideration of various factors, including game device mechanics, aesthetics, and the ability to adapt to different player preferences and environments. There is always a demand for inventive games that can capture the imagination of players and provide them with dynamic and enjoyable experiences. By introducing new concepts and elements, the game ball and rules of play disclosed herein can revitalize the gaming experience and ensure that players remain interested and entertained. This innovation in the gaming industry is essential to meet the ever-changing desires of players and to keep the spirit of playfulness alive.

The example game ball is shown including a spherical body having a first end and a second end positioned opposite to the first end. A plurality of rib structures are provided between the first end and the second end of the body. In the drawings, the body includes 6 rib structures, however, more or less rib structures may be provided based on the desired characteristics of the game ball. Each of the plurality of rib structures are substantially evenly spaced from one another around a circumference of the body.

An open space is defined between each of the rib structures, a span of each open space being substantially the same as a span of each closed space provided by each of the rib structures.

In an example, the rib structures are wider in a central portion than on either end portions of the body of the game ball. The rib structures are substantially symmetrical in both the horizontal orientation and the vertical orientation. Thus, the spherical body is substantially symmetrical in both the horizontal orientation and the vertical orientation.

The game ball and rules of play disclosed herein are primarily designed to be played in a pool or at the beach or lake, but it can be played anywhere including indoors if there is sufficient space. The game can be played using at least one or more hard plastic catching containers or cups, and one or more game balls. The term "cup" as used herein means any container that is suitable for holding the game ball disclosed herein during game play, and having at least one opening for the game ball to pass into and out of the cup. The game is played using the cup to throw and catch the game ball. According to example rules of play, points can be awarded or deducted from a player's score.

In an example, the game ball includes a spherical body defined by a central axis extending between a first pole and a second pole on opposite ends of the spherical body. The spherical body is further defined by a plurality of equally spaced longitudinal lines extending between the first pole and the second pole, and an equatorial circumference that is uniformly equidistant from the first pole and the second pole. The spherical body also includes a plurality of rib structures, with each rib structure being substantially symmetrical about the longitudinal lines between the first pole and the second pole of the spherical body.

The game ball may be played using a cup according to adult-oriented game rules, or family-friendly game rules, each governing the throwing and catching of the spherical body with the cup. These game rules result in players receiving awards for successful catches and penalties for missed catches.

The structure, size, shape, and material of the game ball provide the desired bounce to deliver a "skip and bounce" reaction when the game ball lands on or in the cup. The game ball may be manufactured of a variety of suitable materials, including but not limited to injection molded plastic, to provide the desired bounce.

Before continuing, it is noted that as used herein, the terms "includes" and "including" mean, but is not limited to, "includes" or "including" and "includes at least" or "including at least." The term "based on" means "based on" and "based at least in part on."

The term CUPBALL™ as it may appear in the drawings and/or specification and/or other materials associated with this application and/or the priority application(s) is a trademark for the invention, and all rights are reserved.

It is also noted that the examples described herein are provided for purposes of illustration, and are not intended to be limiting. Other devices and/or device configurations may be utilized to carry out the operations described herein.

The operations and rules of play shown and described herein are provided to illustrate example implementations. It is noted that the operations and rules of play are not limited to the ordering shown, and not all of the operations and rules of play need be included in each game play. Still other operations and rules of play may also be implemented.

Figure 2:
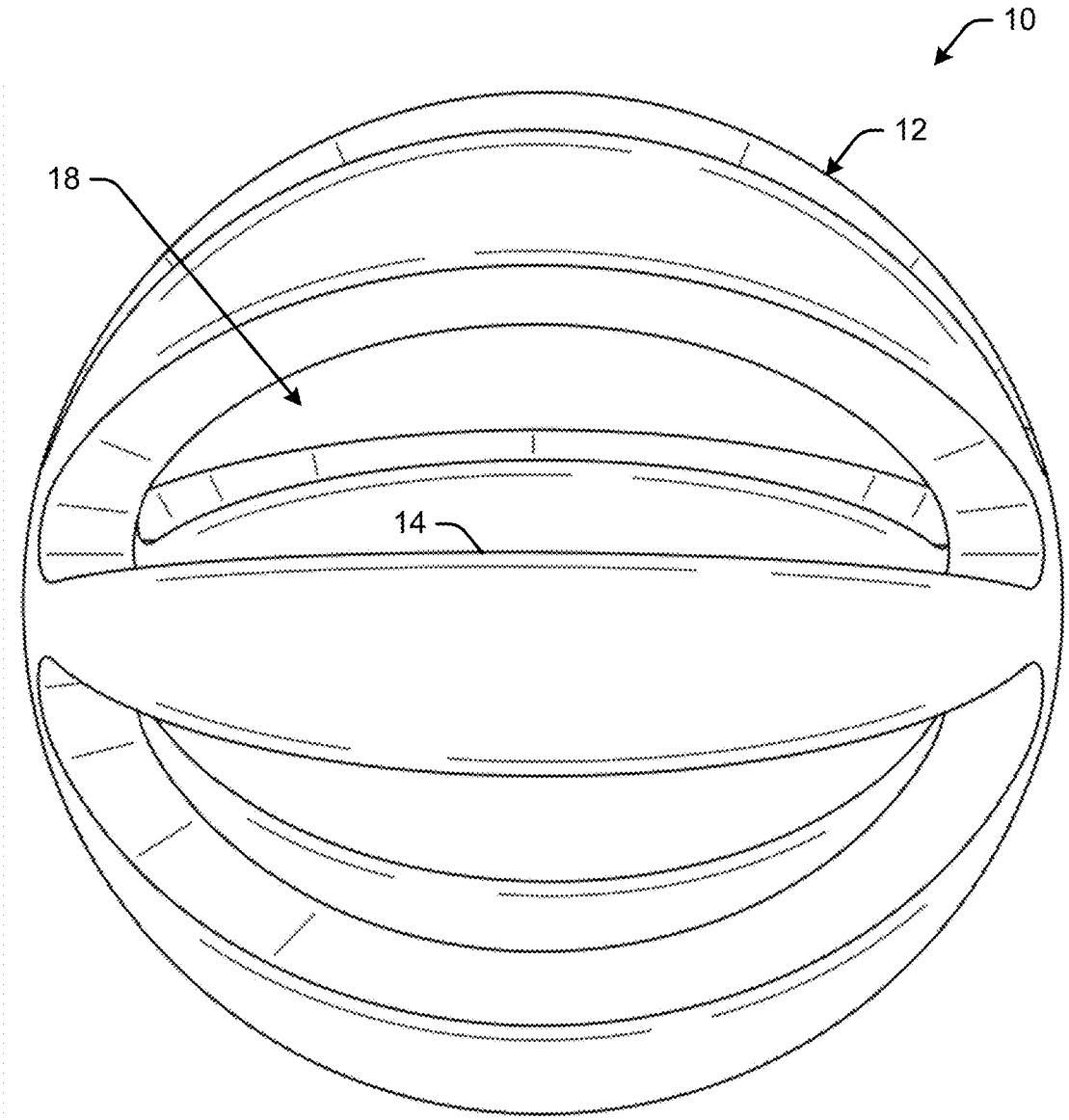
FIG. 2 shows another example of a game ball.

FIG. 1 shows an example game ball 10. In this example, the core of the game ball 10 is partitioned off from the outer surface of the spherical body 12. For example, the game ball 10 may be a solid structure with rib structures 14 and partitions 16 on the outer surface. In another example, it may have a hollow interior that is covered by the partitions 16 between the rib structures 14, thus still having a solid outer structure. In yet another example, the game ball 10 may have a hollow central structure that is open between the rib structures 14. FIG. 2 shows another example of the game ball 10 having a hollow interior with openings 18 formed between each of the rib structures 14. Still other embodiments may also be provided, as will be well understood by those having ordinary skill in the art after becoming familiar with the teachings herein. For example, the partitions may be a mesh or otherwise have openings into the interior cavity of the game ball 10.

Regardless of whether the game ball 10 is open to its interior, there can be said to be a space defined between each of the rib structures 14. In an example, the width of the space at any given location on the rib structures 14 is substantially the same for the space defined between each of the rib structures 14. In an example, the width of the space at any given location on the rib structures is about the same as a corresponding width at any given location of the rib structures. In an example, the space defined between each of the rib structures 14 is closed to the interior. In another example, space is a solid partition formed or otherwise provided between each of the rib structures 14.

In an example, the game ball 10 may have an embossed or debossed logo (not shown). The game ball 10 may have a customizable size. The game ball 10 may have customizable color(s).

Figure 3:
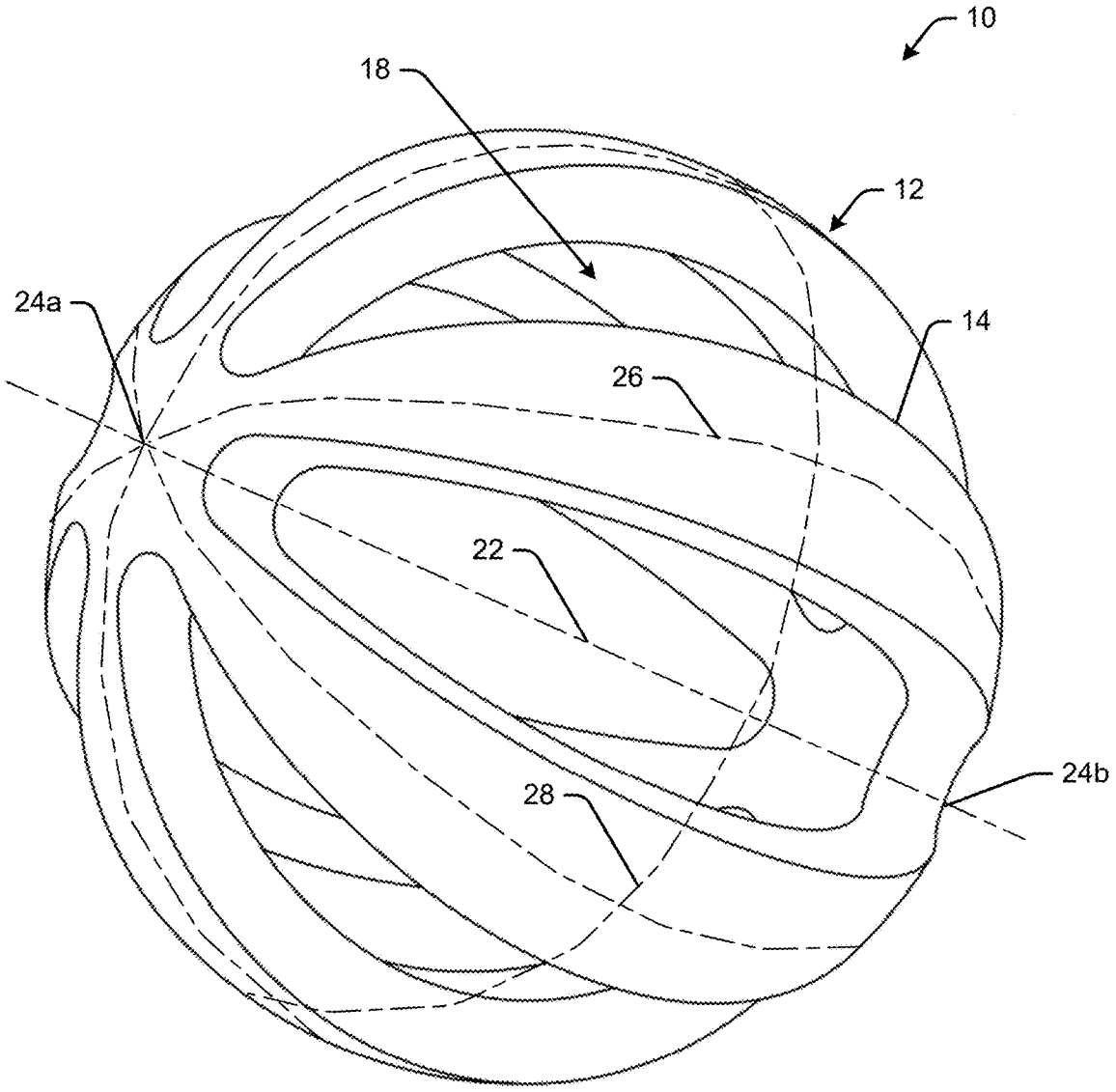
FIGS. 3-5 show various views of the example game ball of FIG. 2.
Figure 4:
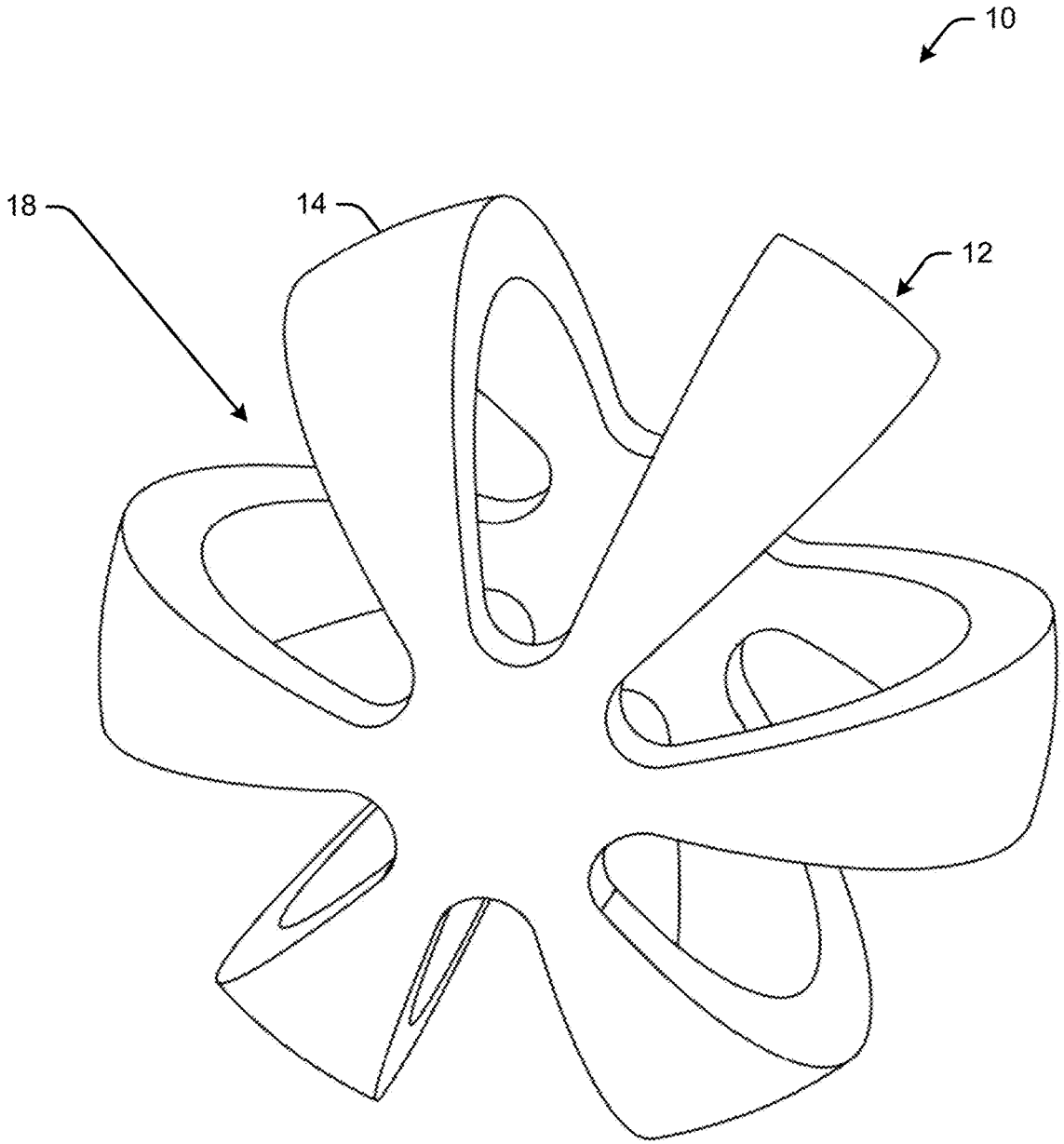
Figure 5:
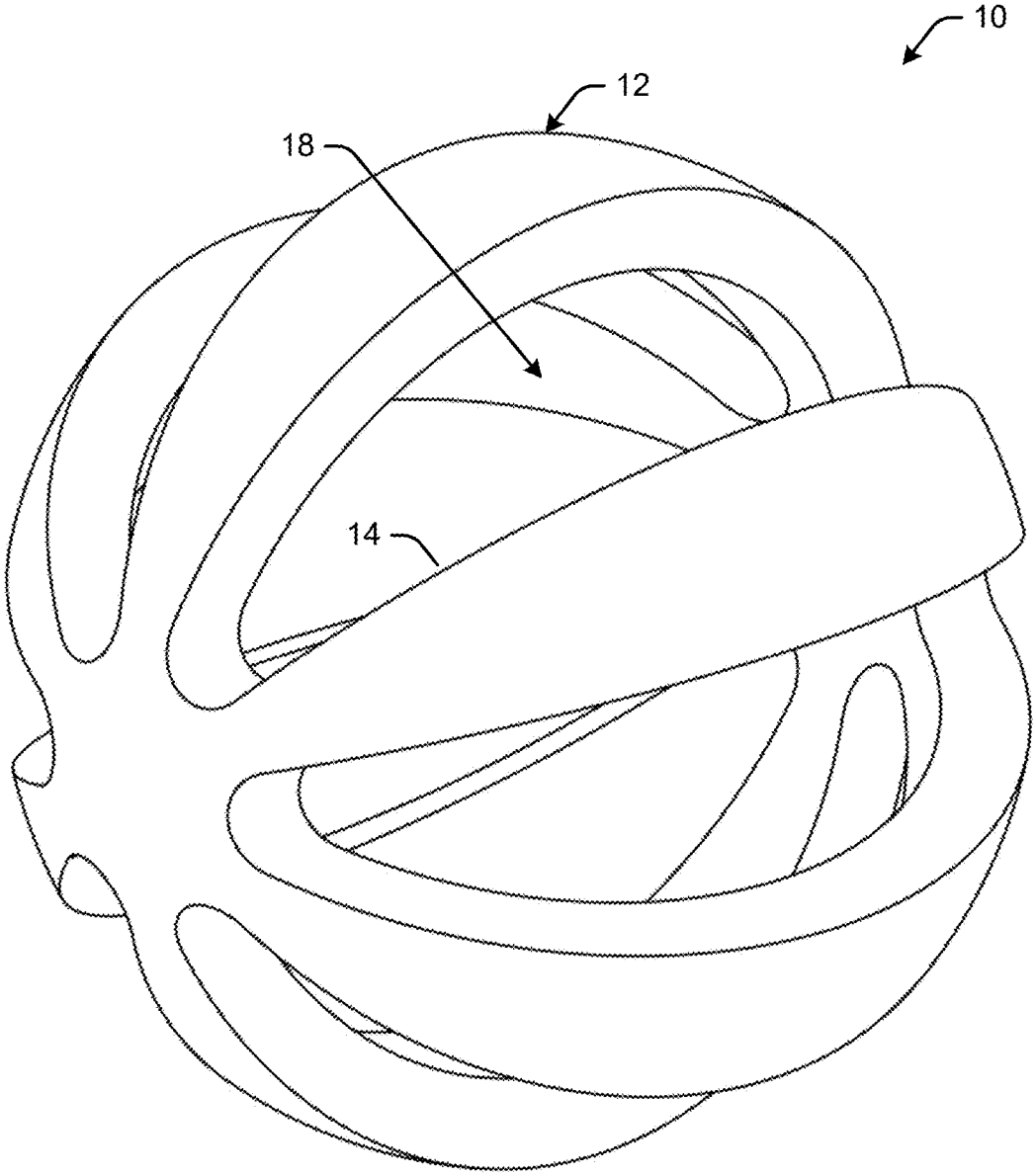

FIGS. 3-5 show various views of the example game ball 10 corresponding to FIG. 2 with the openings 18 formed between each of the rib structures 14. But it is understood that the concepts illustrated FIGS. 3-5 are also applicable to the game ball 10 shown in FIG. 1 that has a solid outer shell or is otherwise partitioned between the rib structures 14 or closed off to the interior.

The game ball 10 has a spherical body 12 defined by a central axis 22 extending between a first pole 24*a* and a second pole 24*b* on opposite ends of the spherical body 12. The spherical body 12 is further defined by a plurality of equally spaced longitudinal lines 26 extending between the first pole 24*a* and the second pole 24*b*. The spherical body 12 is further defined by an equatorial circumference 28 that is uniformly equidistant from the first pole 24*a* and the second pole 24*b*.

In an example, the spherical body 12 as a whole is substantially symmetrical about the central axis 22, and the spherical body 12 is substantially symmetrical about the equatorial circumference 28. In an example, the spherical body 12 has a weight between about 2 ounces and 6 ounces. In an example, the spherical body 12 has a diameter of about 2 inches to about 2.2 inches. In an example, the spherical body 12 has a rubbery texture or feel.

In an example, the spherical body 12 is formed from the rib structures 14 and the end portions (e.g., at the poles 24*a*, 24*b*) as an integral unit. As such, the game ball 10 may be mass produced from a single mold, e.g., by injection molding.

A plurality of rib structures 14 form the spherical body 12. In an example, each of the rib structures 14 connect to one another at the first pole 24*a*, and separately connect to one another on the opposite end at the second pole 24*b*, to form the spherical body 12 as a unitary structure.

The rib structures 14 are each located substantially symmetrically about the longitudinal lines 26 between the first pole 24*a* and the second pole 24*b* of the spherical body 12. In an example, the rib structures 14 maintain a relatively consistent distance from each other along their length at any given point, avoiding any significant convergence or divergence between the poles 24*a*, 24*b*. While perfect symmetry may be difficult to achieve in practice, the design aims for a close approximation, where any deviation is minimal and does not substantially affect the ball's performance.

The configuration of the rib structures 14 can simplify the manufacturing process, particularly when using techniques like injection molding. By having symmetrical rib structures, the mold design becomes less complex, potentially reducing production costs and increasing efficiency. In addition, this arrangement of the rib structures 14 contributes to the unique aerodynamic properties of the game ball 10. When thrown, the rib structures 14 can help to stabilize the flight of the game ball 10, reducing wobble and making it easier to predict the trajectory of the game ball 10. This feature enhances the playability of the game.

In an example, the rib structures 14 are raised portions on the surface of the spherical body 12, creating a textured or uneven surface. The rib structures 14 may vary in size, shape, and spacing, and can be arranged in a variety of patterns around the spherical body. The rib structures 14 can be formed from a variety of materials, including plastic, rubber, or other suitable materials. The rib structures 14 can be designed to provide a number of benefits, such as improving the grip of the game ball 10, increasing the bounce of the game ball 10, or creating a more visually interesting game ball.

In an example, the rib structures 14 of the game ball 10 exhibit a distinctive shape. That is, the rib structures 14 have a mid-portion (near the equatorial circumference 28) that is wider than either of the opposite end portions near the poles 24*a*, 24*b*. This variation in width along the length of the rib structures 14 creates a contoured profile, potentially influencing the aerodynamic properties of the game ball 10 and its interaction with other surfaces, such as the cup 20 (see FIG. 7), during game play. The wider mid-portion provides a more substantial surface area in the central region of the rib structures 14, while the narrower end portions of the rib structures 14 facilitate a smoother transition as the rib structures 14 converge at the poles 24*a*, 24*b*. The mid-portion of each rib is deliberately made wider than its end portions. The wider mid-section may enhance the player's grip on the game ball 10, allowing players to better hold and throw the game ball 10. This configuration can also affect the bounce of the game ball 10, providing a more predictable or dynamic rebound depending on the material and specific dimensions. Furthermore, this unique shape of the rib structures 14 contributes to the overall visual appeal of the game ball 10. It may be quantified in terms of specific measurements or ratios, contributing to the overall geometric properties of the game ball 10. This particular rib structure profile can be achieved through various manufacturing processes, such as injection molding, and is intended to produce certain gameplay characteristics.

It is noted that this design of the rib structures 14 is not strictly required, and other embodiments could have ribs of uniform width, or ribs that taper in the middle. However, the wider mid-section offers potential benefits, such as increased grip and modified airflow around the ball, which might improve control and throwing distance during game play.

In an example, both of the opposite end portions of the rib structures 14 near the poles 24*a*, 24*b* are substantially the same width. In an example, the rib structures 14 are substantially symmetrical about their horizontal axis (e.g., the longitudinal lines 26), and the rib structures 14 are substantially symmetrical about their vertical axis (e.g., at the equatorial circumference 28).

Figure 6:
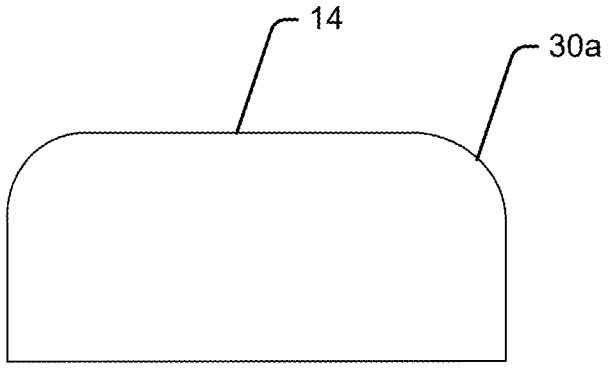
FIG. 6 shows cross sectional views of an example rib structure of the game ball.
Figure 6:
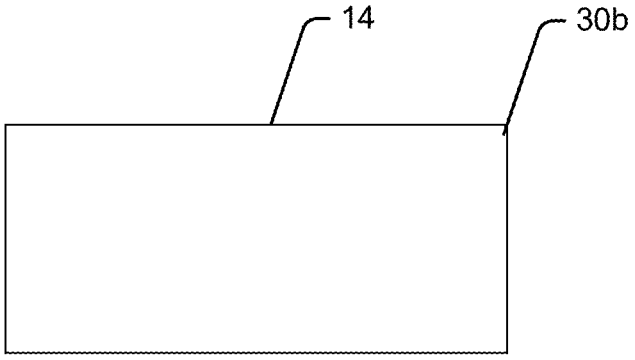

FIG. 6 shows two profiles or cross sectional views of a rib structure 14. In an example, the rib structure 14 may have at least partially rounded edges 30*a*. In another example, the rib structure 14 may have square edges 30*b*.

Figure 7:
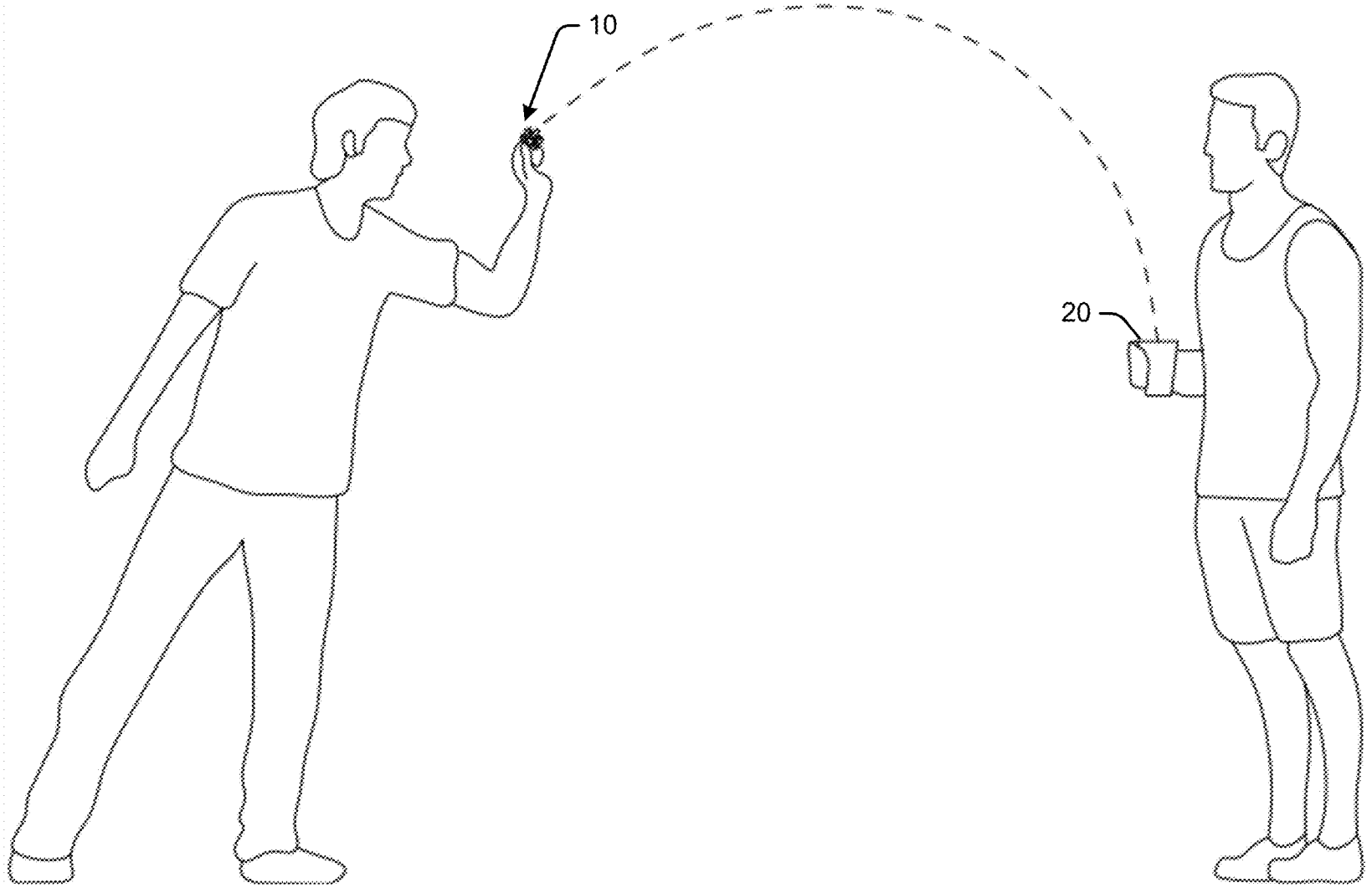
FIG. 7 illustrates rules of play for the game ball.

FIG. 7 illustrates rules of play for the game ball 10. The game is intended to be played with one or more cups 20 in a pool, but can also be played on the beach, in a lake, in the ocean, or even someone's backyard or other places (even indoors if there is sufficient space). Although the player is shown throwing the game ball 10 from his/her hand in FIG. 7, it is noted that both players may have cups 20 that are used to throw and/or catch the game ball 10. Of course, the game ball 10 may be played with any number of players, game balls 10, and/or cups 20 according to other suitable game rules. The game rules provided below are exemplary only, and not intended to be limiting. The number of points awarded and/or taken away may vary.

All players start with zero (0) points, and the first player to ten (10) points wins. Points are deducted from a player for bad Basic Throws or missed Basic Catches. Points can also be deducted or earned from Special Catches and Special Throws. Additionally, points are deducted or earned based on Penalties or Highlight Reel.

Example Rules of Play—Rated for all Ages/Everyone.

All players start with 0 points. Win by being the first player to reach 11 points or the last player to avoid reaching −11 points.

Basic Throws and Catches. Throw the ball using the cup and catch the ball using the cup. If you make an uncatchable throw, lose a point. If you miss a catchable toss, lose a point.

Extra points are also earned or lost based on Crowd Pleasers, What a Catch!, and Oops! events that happen while playing.

Crowd Pleasers. Standing O—Make a catch that is so spectacular it draws applause, comments, or oohs and aahs from any spectator or player—earn three points. Encore—Make two consecutive Crowd Pleaser catches in a row—earn five points.

As you reach milestone throws and catches, be extra careful. Make a bad throw or miss a catchable ball on 10 in a row, lose one point. Make a bad throw or miss a catchable ball on 20 in a row, lose two points. Make a bad throw or miss a catchable ball on 30 in a row, lose three points.

What a Catch! Off the Rim—Bounce the ball off the rim of the cup and catch it. Succeed, earn three points. Fail, lose two points.

Upside Down—Bounce the ball off the bottom of the cup and catch it. Succeed, earn three points. Fail, lose two points.

Oops! Face Plant—Ball hits off the rim and ricochets into the face. Lose one point. Body Blow—Ball hits body first before hitting the cup. Lose one point. Boing!—Ball is caught but hits the bottom of cup and bounces out. Lose one point.

Land Lover—Had to leave the pool to retrieve a bad throw. Lose one point.

Peeing in the pool—Have not left the pool for more than one hour. Lose three points.

Innocent Bystander—Ball hits someone who is not playing. Lose five points.

Example Rules of Play—Rated for Adults 21 years or older.

Basic Throws and Catches. Throw the ball using the cup and catch the ball using the cup. If you make an uncatchable throw, drink. If you miss a catchable toss, drink.

Extra drinks are also given or taken based on Happy Hour Specials, Party Fouls, and Cheers to that! events that happen while playing.

Happy Hour Specials. Make it a three-some—or more—with crowd interaction and participation.

The Orgasm—Make a catch that is so spectacular it draws applause, comments, or oohs and aahs from any spectator or player. Give two drinks.

Multiple Orgasms—This isn't just for the women out there playing, a guy can achieve this feat, too! Make two consecutive Orgasm catches to enjoy the pleasure of this rare, yet satisfying, accomplishment. Give four drinks.

Social—Count successful throws and catches aloud for everyone to hear. As milestones are reached, encourage all spectators to also drink. Reach 10 in a row, and all players take one drink. Reach 20 in a row, and all players take two drinks. Reach 30 in a row, and all players take three drinks, and so on.

Money Shot—It's the big moment everyone has been waiting for, if there is a bad throw or dropped catchable toss on any potential Social. Take one drink on 10 in a row. Take two drinks on 20 in a row. Take three drinks on 30 in a row, and so on.

Cheers to that!

Raise a glass to celebrate the occasion when these unique catches happen.

Rim Job—Bounce the ball off the rim of the cup and catch it. Succeed, give one drink. Fail, take two drinks.

Wrong Hole—Bounce the ball off the bottom of the cup and catch it Succeed, give one drink. Fail, take two drinks.

Party Fouls. As the saying goes, things happens. Facial—Ball hits off the rim and ricochets into the face. Take one drink.

Body Shot—Ball hits body first before hitting the cup. Take one drink.

Upchuck—Ball is caught but hits the bottom of cup and bounces out. Take one drink.

Walk of Shame—Had to leave the pool to retrieve a bad throw. Take one drink.

Golden Shower—Have not left the pool for more than one hour. Take one drink.

The F Word—Foul language is used, and a kid hears it. Take one drink and apologize to whoever is responsible for said kid.

Boinking—Ball hits someone who is not playing. Take one drink and offer to buy the innocent bystander a drink.

It is noted that the examples shown and described are provided for purposes of illustration and are not intended to be limiting. Still other examples are also contemplated.

The invention claimed is:

1. A game ball comprising:

a spherical body defined by a central axis extending between a first pole and a second pole on opposite ends of the spherical body, the spherical body further defined by a plurality of equally spaced longitudinal lines extending between the first pole and the second pole, the spherical body further defined by an equatorial circumference that is uniformly equidistant from the first pole and the second pole; and a plurality of rib structures of the spherical body, the rib structures each being substantially symmetrical about the longitudinal lines between the first pole and the second pole of the spherical body.

2. The game ball of claim 1, wherein the plurality of rib structures are substantially evenly spaced about the equatorial circumference relative to one another.

3. The game ball of claim 1, wherein the plurality of rib structures form a plurality of ridges about an outer surface of the spherical body.

4. The game ball of claim 1, wherein the rib structures have a mid-portion that is wider than either of the opposite end portions.

5. The game ball of claim 4, wherein both of the opposite end portions of the rib structures are substantially the same width.

6. The game ball of claim 1, wherein the rib structures are substantially symmetrical about a horizontal axis, and the rib structures are substantially symmetrical about a vertical axis.

7. The game ball of claim 1, wherein the spherical body is substantially symmetrical about the central axis, and wherein the spherical body is substantially symmetrical about the equatorial circumference.

8. The game ball of claim 1, wherein each of the rib structures connect to one another at the first pole, and separately connect to one another at the second pole to form the spherical body as a unitary structure.

9. The game ball of claim 1, wherein the plurality of rib structures have rounded edges.

10. The game ball of claim 1, wherein the spherical body has a weight of between about 2 ounces and 6 ounces.

11. The game ball of claim 1, wherein the spherical body has a diameter of about 2 inches to about 2.2 inches.

12. The game ball of claim 1, wherein the spherical body has a rubbery texture.

13. The game ball of claim 1, further comprising a space defined between each of the rib structures, a width of the space at any given location on the rib structures being substantially the same for the space defined between each of the rib structures.

14. The game ball of claim 13, wherein the width of the space at any given location on the rib structures is about the same as a corresponding width at any given location of the rib structures.

15. The game ball of claim 13, wherein the space defined between each of the rib structures is closed to a core of the spherical body.

16. The game ball of claim 15, wherein the spherical body is solid between each of the rib structures and the core.

17. The game ball of claim 13, wherein the space defined between each of the rib structures is open to a core of the spherical body.

18. The game ball of claim 17, wherein the core of the spherical body is hollow.

19. The game ball of claim 1, further comprising adult-oriented game rules governing throwing and catching of the spherical body with a cup, wherein the game rules result in players receiving awards for catches, and the game rules result in the players receiving penalties for missed catches.

20. The game ball of claim 1, further comprising family-friendly game rules governing throwing and catching of the spherical body with a cup, wherein the game rules result in players receiving awards for catches, and the game rules result in the players receiving penalties for missed catches.

* * * * *